US007174604B2

(12) United States Patent
Yoo et al.

(10) Patent No.: US 7,174,604 B2
(45) Date of Patent: Feb. 13, 2007

(54) UPRIGHT VACUUM CLEANER WITH SLIDING POWER INDICATOR SWITCH

(75) Inventors: Byung-Do Yoo, Ansan (KR); Suk-Young Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 575 days.

(21) Appl. No.: 10/372,120

(22) Filed: Feb. 25, 2003

(65) Prior Publication Data

US 2004/0083571 A1 May 6, 2004

(30) Foreign Application Priority Data

Nov. 1, 2002 (KR) ..... 10-2002-0067557

(51) Int. Cl.
*A47L 9/00* (2006.01)

(52) U.S. Cl. ..... 15/339; 15/319; 15/DIG. 10

(58) Field of Classification Search ..... 15/339, 15/351, DIG. 10; 200/332.2, 308, 310, 313, 200/317, 293.1, 61.85, 61.86, 547, 252; 116/279, 116/281–283, 321–324, 307, DIG. 1
See application file for complete search history.

(56) References Cited

U.S. PATENT DOCUMENTS 1,992,731 A * 2/1935 Allen ..... 15/DIG. 10
4,348,564 A * 9/1982 Ohtaki et al. ..... 200/252
4,920,607 A * 5/1990 Kohn ..... 15/339
5,081,738 A * 1/1992 Schiller et al. ..... 15/339
5,507,067 A * 4/1996 Hoekstra et al. ..... 15/319
5,983,444 A * 11/1999 Jacobs et al. ..... 15/339
6,490,752 B2 * 12/2002 Kushida et al. ..... 15/319

* cited by examiner

*Primary Examiner*—Theresa T. Snider
(74) *Attorney, Agent, or Firm*—Fleshner & Kim, LLP

(57) ABSTRACT

The present invention relates to an upright vacuum cleaner. An upright vacuum cleaner according to the present invention includes a main body for housing a suction power generating device for sucking air and a filtering device for filtering out foreign substances contained in the sucked air. A suction nozzle is pivotably connected to a lower portion of the main body for sucking the air containing the foreign substances and then guiding the sucked air into the main body. A handle is installed at the top of the main body and is designed to be gripped by a user in use. The potentiometer, or some other device for controlling the electric current applied to the suction power generating device, is installed at one side surface of the handle. The potentiometer allows the user to control a suction power level and on/off operations of the vacuum cleaner by means of a sliding manipulation. Further, the potentiometer is preferably installed at a front surface of the handle.

15 Claims, 4 Drawing Sheets

UPRIGHT VACUUM CLEANER WITH SLIDING POWER INDICATOR SWITCH

BACKGROUND OF THE INVENTION

1. Field of the Invention

The present invention relates to an upright vacuum cleaner, and more particularly, to an upright vacuum cleaner, in which a switch capable of controlling a suction power level is mounted on a handle, which is gripped by a user in use, and thus, the suction power level can be easily controlled and the vacuum cleaner can be conveniently used.

2. Description of the Prior Art

FIGS. 1 and 2 show a general upright vacuum cleaner. As shown in the figures, the general upright vacuum cleaner comprises a main body 2 for housing a suction power generating means for producing suction power and a filtering means for filtering out foreign substances contained in sucked air; and a suction nozzle 4 installed at a lower portion of the main body for sucking the foreign substances from a floor.

A suction hole for introducing the air containing the foreign substances is formed on a bottom face of the suction nozzle 4. The suction nozzle is installed to be pivoted with respect to the main body 2 in a predetermined angular range. When not in use as shown in FIGS. 1 and 2, the main body 2 is maintained to be upright at a predetermined angle with respect to the suction nozzle. On the other hand, when in use, by depressing a releasing pedal 12 installed at a rear end of the suction nozzle 4, the main body 2 can be pivoted rearward of the suction nozzle 4 in a predetermined angular range.

In addition, a handle 6 is formed at the top of the main body 2. The handle 6 is a portion constructed such that cleaning can be performed while it is gripped by the user in use. That is, in a state where the handle 6 is gripped by the user, the cleaning of places to be cleaned can be performed while the angle of the main body 2 with respect to the suction nozzle is adjusted.

The filtering means (not shown) installed within the main body 2 may be separated from the main body 2 after opening a main body cover 2*a*.

Overall operations of the upright vacuum cleaner constructed as such will be described. When a power cord 10 is unwound and then connected to a wall outlet, the vacuum cleaner is in a state where electric power can be applied to the vacuum cleaner.

In this state, when a switch 8 installed at one side surface of the main body 2 is manipulated, the vacuum cleaner starts. If the vacuum cleaner starts, the foreign substances existing on the floor is sucked together with the air through the suction hole formed at the bottom face of the suction nozzle 4. Thus, the cleaning can be performed while the handle 6 is gripped by the user and the vacuum cleaner is moved on the floor to be cleaned.

The air containing the foreign substances, which has been sucked in such a cleaning process, is guided into the main body 2 through a connection hose 14. The air, which has been guided into the main body 2, is filtered by the filtering means housed in the main body 2. Since the connection hose 14 can be separated from the suction nozzle 4, corner places can be cleaned using only the connection hose 14, if necessary.

After the air from which the foreign substances have been filtered out by the filtering means within the main body 2 passes by the suction power generating means while dissipating heat therefrom, it is then discharged to the outside.

However, in the conventional vacuum cleaner constructed as such, there is the following inconvenience in use.

Generally, when the vacuum cleaner starts, the handle 6 is gripped by the user's one hand. In order to drive the vacuum cleaner, the switch 8 installed at the one side surface of the main body 2 should be turned on. However, since the handle is gripped by the one hand, there is inconvenience in use in that the switch 8 should be manipulated by the other hand.

Further, in the conventional upright vacuum cleaner, a switch capable of controlling only on/off operations is used as the switch 8. Accordingly, there may occur a case where it fails to control a suction power level during cleaning. That is, if necessary, a higher suction power level may be required during cleaning, or control may be required to produce a lower suction power level in the course of the cleaning. However, according to the conventional vacuum cleaner, there is a disadvantage in that it is always driven at a constant suction power level.

SUMMARY OF THE INVENTION

The present invention is contemplated to solve the problem in the prior art. An object of the present invention is to provide an upright vacuum cleaner wherein simple on/off operations thereof can be conveniently performed.

Another object of the present invention is to provide an upright vacuum cleaner capable of controlling a suction power level.

According to the present invention for achieving the objects, there is provided an upright vacuum cleaner, comprising: a main body for housing a suction power generating means for sucking air and a filtering means for filtering out foreign substances contained in the sucked air; a suction nozzle pivotably connected to a lower portion of the main body for sucking the air containing the foreign substances and then guiding the sucked air in to the main body; a handle installed at the top of the main body and gripped by a user in use; and a potentiometer installed at one side surface of the handle and capable of controlling a suction power level and on/off operations of the vacuum cleaner by means of a sliding manipulation.

The potentiometer is preferably installed at a front surface of the handle.

According to an embodiment of the potentiometer, the potentiometer comprises a slide volume switch assembly which contains a plurality of contacts having different resistance therein and from which a slide element protrudes; a board which is installed at a front surface of the switch assembly and on which indications for suction power levels are printed; and a slide knob installed at a front surface of the board, operated by the user, and interlocked with the slide element, and wherein the potentiometer is installed in an opening formed in the handle so that the board and slide knob are exposed to the outside at the front surface.

According to the present invention constructed as such, it can be expected to obtain advantages in that the suction power level can be very conveniently controlled by the potentiometer installed at the handle of the upright vacuum cleaner, and in that since the suction power level can be controlled in a multi-stage manner, the efficiency of cleaning can be increased.

BRIEF DESCRIPTION OF THE DRAWINGS

The above and other objects and features of the present invention will become apparent from the following description of a preferred embodiment given in conjunction with the accompanying drawings, in which.

DETAILED DESCRIPTION OF THE PREFERRED EMBODIMENTS

Hereinafter, a preferred embodiment of the present invention will be described in detail with reference to the accompanying drawings.

Figure 1:
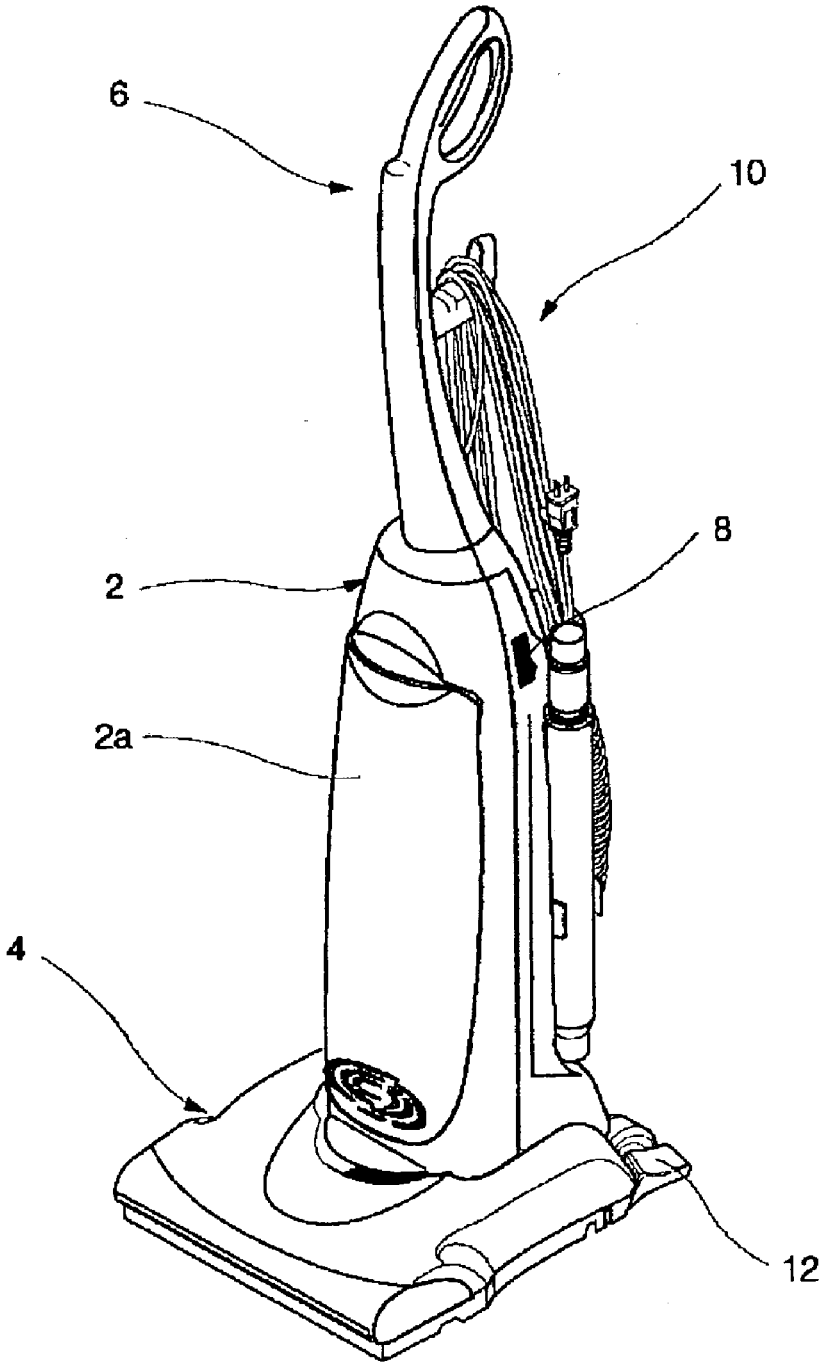
FIG 1 (PRIOR ART)
FIG. 1 is a front perspective view of a conventional upright vacuum cleaner.
Figure 2:
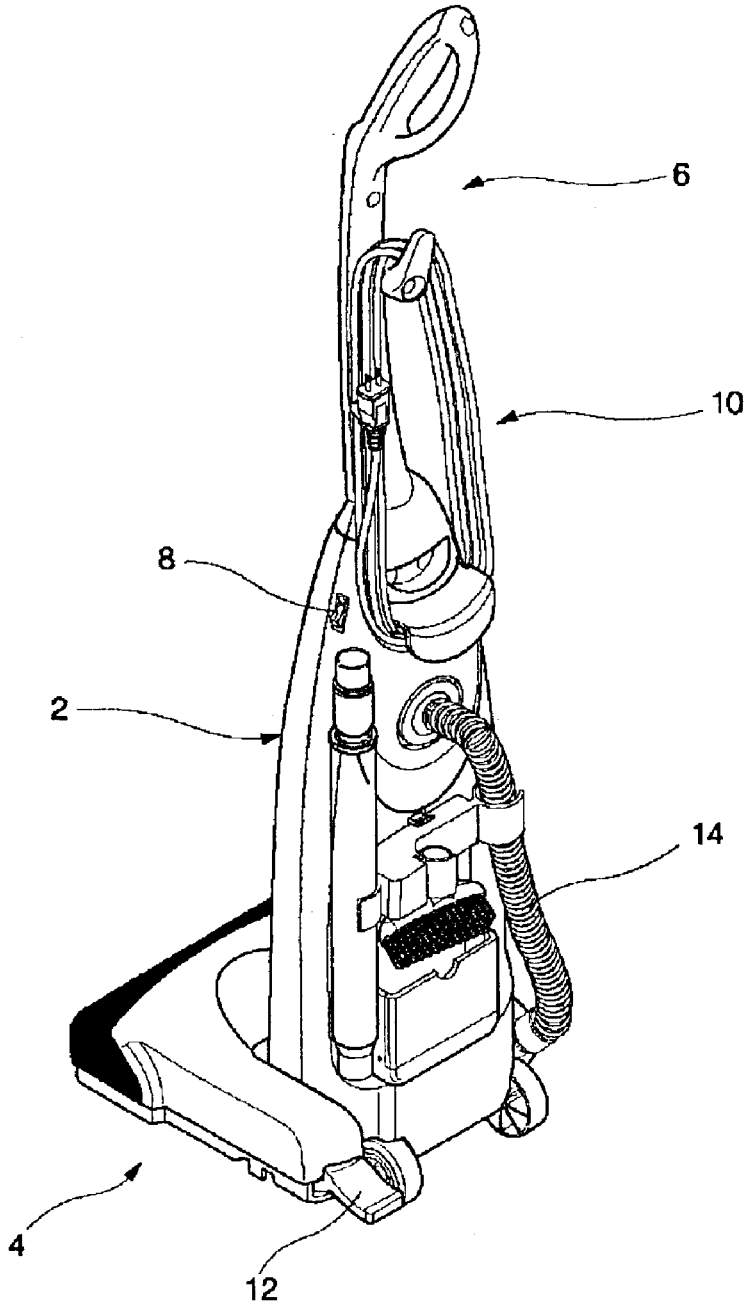
FIG 2 (PRIOR ART)
FIG. 2 is a rear perspective view of the conventional upright vacuum cleaner.
Figure 3:
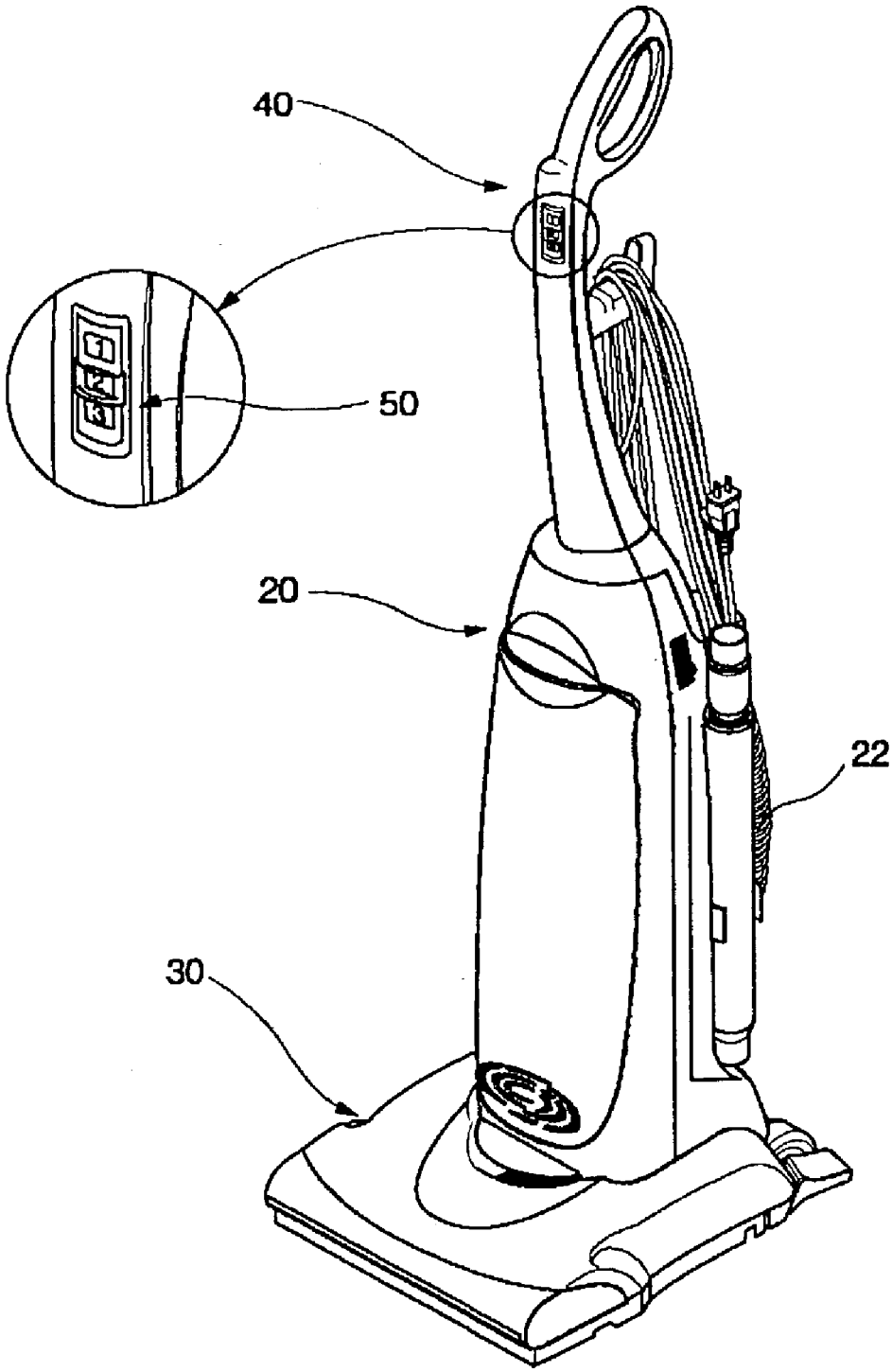
FIG. 3 is a front perspective view of an upright vacuum cleaner according to the present invention.

As shown in FIG. 3, an upright vacuum cleaner according to the present invention comprises a main body 20 for housing a suction power generating means, such as a motor, for producing suction power; and a suction nozzle 30 pivotably connected to a lower end of the main body.

The suction power generating means such as a motor for producing suction power is housed within the main body 20. A filtering means for filtering out foreign substances contained in air sucked by the suction power generating means is also housed within the main body 20. The filtering means may be composed of, for example, a paper filter for allowing only air other than the foreign substances to pass therethrough, or a cyclone type dust collecting unit including a casing for performing dust collection in a cyclone fashion.

A handle 40, which is gripped by a user upon cleaning, is installed at an upper end of the main body 20. In a state where the handle 40 has been gripped by the user, the cleaning can be performed while the angle of the main body 20 is controlled with respect to the suction nozzle 30 that is in close contact with a floor.

According to the present invention, a switching device 50 is installed at a front surface of the handle 40. A potentiometer, which can change an electyric current value to be output in a slide manner and is referred to as so called "a sliding switch", is used as the switching device 50 according to the present invention. potentiometer 50 includes a plurality of contacts having different resistance. Accordingly, if electric current flows through the contacts having different resistance, the electric current value to be output is changed, which is well known to the skilled in the art.

Based on the different electric current values to be output through the respective contacts having different resistance, a suction power level of the suction power generating means within the vacuum cleaner is also correspondingly controlled. Accordingly, by manipulation of the potentiometer 50, on/off operations of the vacuum cleaner can be performed and the suction power level of the suction generating means within the vacuum cleaner can also be controlled.

The switching device according to the present invention, i.e., the potentiometer 50, is installed at the one side surface of the handle 40. Accordingly, in a state where the handle 40 is gripped by the user in order to use the vacuum cleaner, the potentiometer 50 can be directly manipulated. That is, in a state where the handle 40 is gripped by the user's one hand, the potentiometer 50 can be manipulated by the user's one hand. Thus, the vacuum cleaner according to the present invention can be conveniently used, compared with the conventional vacuum cleaner.

potentiometer 50 according to the present invention is installed at one side surface of the handle 40. That is, it is sufficient that the potentiometer is installed at the one side surface of the handle 40 so that it can be manipulated by the user's one hand in a state where the handle 40 is gripped by the user's one hand. However, as shown in the figure, by preferably installing the potentiometer 50 at the front surface of the handle 40, the suction power level of the vacuum cleaner can be visually controlled according to the user's desire.

Figure 4:
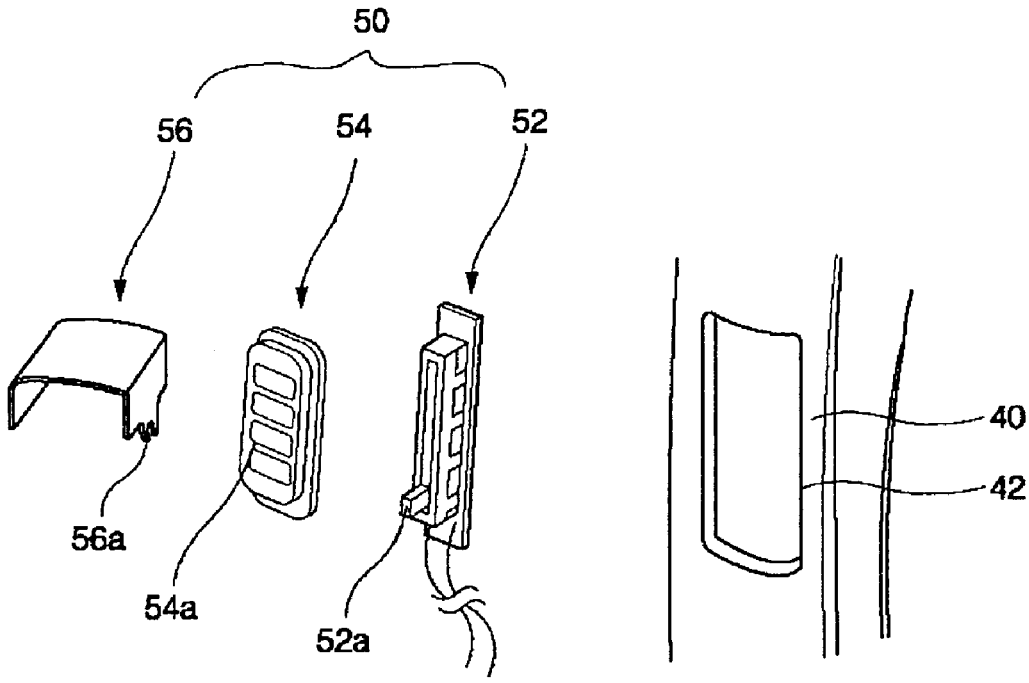
FIG. 4 is an exploded perspective view of a potentiometer according to an embodiment of the present invention.

Next, one embodiment of the potentiometer 50 will be described. As shown in FIG. 4, the potentiometer 50 included in an opening 42 of the handle 40 comprises a slide volume switch assembly 52 containing a plurality of contacts having a different resistance; a board 54 installed at a front surface of the slide volume switch assembly 52; and a slide knob 56 that is installed at a front surface of the board and slides along and over the board.

The interior of the slide volume switch assembly 52 is provided with the plurality of contacts having different resistance. A slide element 52*a* installed in the slide volume switch assembly 52 allows selective switching to each contact having different resistance while being slid longitudinally within the switch assembly 52.

An indication portion 54*a* for indicating the suction power level and the state of on/off operations is printed on the front surface of the board 54. The board 54 is installed in the opening 42 of the handle 40 so that the indication portion 54*a* is exposed to the outside. Accordingly, the user can observe the indication portion 54*a*.

The slide knob 56 is installed at the front surface of the board 54. The slide knob 56 is installed in a state where it is exposed to the outside from the opening 42 of the handle 40, and it can be slid longitudinally while being supported by the board 54. A downward extending connection portion 56*a* is formed at one side surface of the slide knob 56. The connection portion 56*a* is a portion engaged with the slide element 52*a* of the switch assembly 52 so that the slide element 52*a* can be longitudinally slid.

Upon manipulation of the potentiometer 50 constructed as such, the slide knob 56 is longitudinally slid by the user's hand. By means of the longitudinal sliding of the slide knob 56, the connection portion 56*a* causes the slide element 52*a* to slide, so that the contact having a desired resistance value among the plurality of contacts in the switch assembly 52 can be activated. The contact for obtaining desired suction power can be selected while the indication portion 54*a* printed on the front surface of the bard 54 is observed by the user. Thus, if the desired contact is selected, the suction power of the suction power generating means is determined by drive of the suction power generating means based on the electric current value to be output from the switch assembly 52. Accordingly, the desired suction power can be obtained.

Usage of the upright vacuum cleaner constructed as such will be briefly described. When the potentiometer 50 is manipulated in a state where the handle 40 is gripped by the user's hand, the suction power level of the vacuum cleaner can be controlled. For example, by linearly sliding the slide knob 56, the vacuum cleaner can start and the suction power level can be controlled depending on circumstances of places to be cleaned even during operation of the vacuum cleaner.

By means of the sliding manipulation of the potentiometer 50, the actual cleaning can be performed while the on/off operations and suction power level of the vacuum cleaner are substantially controlled. The suction power of the upright vacuum cleaner is produced by drive of the motor installed within the main body 20 by means of the manipulation of the potentiometer 50, as described above.

With the suction power produced as such, the air introduced through a bottom face of the suction nozzle 30 is introduced into the main body 20 through the connection hose 22. While the air introduced into the main body 20 passes through the filtering means, the foreign substances contained in the air are filtered out. The filtering means may be composed of a paper envelope or a dust collecting unit which performs dust collection in a cyclone fashion.

Thus, after the foreign substances have been collected, the air passes by the suction power generating means while dissipating heat therefrom, and is then discharged to the outside.

As described above, according to the present invention, it can be seen that the potentiometer 50 is installed at the one side surface of the handle 40 and the upright vacuum cleaner is constructed such that its suction power level can be controlled in a multi-stage manner by 50.

Accordingly to the present invention described above, the following effects can be expected:

First, since the potentiometer is installed at the one side surface, preferably, the front surface of the handle 40 of the upright vacuum cleaner, the potentiometer can be simultaneously manipulated in a state where the handle is gripped by the user. Therefore, the on/off operations and the suction power level control can be conveniently made by the user.

Further, according to the potentiometer 50 of the present invention, the on/off operations of the vacuum cleaner can be easily performed and an output level for indicating a desired suction power level can be easily set up. Therefore, it can be expected to obtain an advantage in that more efficient cleaning can be performed by controlling the suction power level depending on the circumstances of the place to be cleaned.

It will be apparent that those skilled in the art can make various modifications within the scope of the technical spirit of the invention. For example, the potentiometer 50 of the present invention means a switch constructed to substantially determine the suction power level in the sliding manner. Therefore, it is apparent that various modifications can be made within a range of equivalent switching devices, which can determine the suction power level in the sliding manner.

Further, the present invention should be construed based on the appended claims.

What is claimed is:

1. A vacuum cleaner, comprising:

a main body housing a suction generating device and a filtering device;

a suction nozzle coupled to the suction generating device in the main body and configured to suck air containing foreign substances;

a handle coupled to the main body and configured to be gripped by a user while the vacuum cleaner is in use; and a control switch installed on the handle and configured to control an on/off operation of the vacuum cleaner and to control a suction power of the suction generating device, wherein the control switch comprises:

a sliding electrical switch mounted on the handle and having a slide element that is capable of causing the suction generating device to turn on and off, and capable of controlling an amount of suction provided by the suction generating device;

an indicator mounted on the handle and having markings to indicate different suction power levels; and a sliding knob mounted over the indicator and configured to be moved, by the user, to selectively overlie different portions of the indicator to provide an indication of the suction power level setting of the vacuum cleaner in combination with the indicator, wherein the sliding knob includes a connection portion that is coupled to the slide element of the sliding electrical switch such that the slide elements moves with the sliding knob.

2. vacuum cleaner of claim 1, wherein at least a portion of the sliding knob is substantially transparent, and wherein the control switch is configured such that the portion of the indicator underlying the transparent portion of the sliding knob provides an indication of the operational status of the vacuum cleaner.

3. The vacuum cleaner of claim 2, wherein the sliding electrical switch comprises a potentiometer.

4. The vacuum cleaner of claim 3, wherein movement of the sliding knob causes the slide element of the sliding electrical switch to contact different ones of a plurality of contacts within the switch that each have a different electrical resistance.

5. The vacuum cleaner of claim 1, wherein the sliding electrical switch comprises a potentiometer.

6. The vacuum cleaner of claim 5, wherein movement of the sliding knob causes the slide element of the sliding electrical switch to contact different ones of a plurality of contacts within the switch that each have a different electrical resistance.

7. The vacuum cleaner of claim 6, wherein the vacuum cleaner is an upright vacuum cleaner.

8. The vacuum cleaner of claim 7, wherein the suction nozzle is pivotally connected to a lower portion of the main body, and wherein the handle is coupled to an upper portion of the main body.

9. The vacuum cleaner of claim 7, wherein the control switch is mounted on a front face of the handle such that it can be viewed by a user when the user is operating the vacuum cleaner.

10. upright vacuum cleaner, comprising:

a main body housing a suction generating device and a filtering device;

a suction nozzle pivotally coupled to a lower portion of the main body, and operatively coupled to the suction generating device, and configured to suck air containing foreign substances;

a handle coupled to an upper portion of the main body and configured to be gripped by a user while the vacuum cleaner is in use; and a control switch installed on the handle and configured to control an on/off operation of the vacuum cleaner and to control a suction power of the suction generating device, wherein the control switch comprises:

a potentiometer mounted on the handle and having a slide element that is capable of causing the suction generating device to turn on and off, and that is capable of controlling an amount of suction provided by the suction generating device; and a sliding indicator mounted on the handle and coupled to the slide element so that the slide element moves with the sliding indicator, wherein the sliding indicator can be moved by the user to a plurality of different positions, and wherein the position of the sliding indicator provides an indication of the operational status of the vacuum cleaner; and wherein the sliding indicator comprises:

an indicator mounted on the handle and having markings to indicate different suction power levels; and a sliding knob mounted over the indicator.

11. The vacuum cleaner of claim 10, wherein the position of the sliding indicator provides an indication of a suction power level setting of the vacuum cleaner.

12. The vacuum cleaner of claim 10, wherein the control switch is configured such that the sliding knob can be selectively moved by the user such that it overlies a plurality of different portions of the indicator.

13. The vacuum cleaner of claim 12, wherein at least a portion of the sliding knob is substantially transparent, and wherein the control switch is configured such that the portion of the indicator underlying the transparent portion of the sliding knob provides an indication of the operational status of the vacuum cleaner.

14. The vacuum cleaner of claim 10, wherein movement of the sliding indicator causes the slide element to contact different ones of a plurality of contacts within the control switch that each have a different electrical resistance.

15. The vacuum cleaner of claim 10, wherein the control switch is mounted on a front face of the handle such that it can be viewed by a user when the user is operating the vacuum cleaner.

* * * * *